United States Patent [19]

Kobus

[11] Patent Number: 4,741,165

[45] **Date of Patent: * May 3, 1988**

[54] TWIN ENGINE SYNCHRONIZER

[76] Inventor: John R. Kobus, 18 Elm Pl., Red Bank, N.J. 07701

[ * ] Notice: The portion of the term of this patent subsequent to May 6, 2003 has been disclaimed.

[21] Appl. No.: 856,641

[22] Filed: Apr. 25, 1986

[51] Int. Cl.[4] ..... F02B 73/00

[52] U.S. Cl. ..... 60/700; 60/702; 74/89.15; 74/501 R; 74/625

[58] Field of Search ..... 60/698, 700, 701, 702, 60/711, 716; 74/89.15, 501 R, 625

[56] References Cited

U.S. PATENT DOCUMENTS 4,586,341 5/1986 Kobus ..... 60/711

*Primary Examiner*—Allen M. Ostrager

*Attorney, Agent, or Firm*—Ralph W. Selitto, Jr.

[57] ABSTRACT

Disclosed herein are apparatus for synchronizing the speeds of two or more engines, each having its own throttle lever connected by an associated cable to a respective hand throttle lever. More particularly, the throttle lever of one of the engines is moved independently of its associated cable and its respective hand throttle lever to increase or decrease the speed of the engine until its speed matches the speed of the other engine or engines, whereby the speeds of the engines may be synchronized without moving their associated cables or their respective hand throttle levers.

41 Claims, 6 Drawing Sheets

FIG. 6
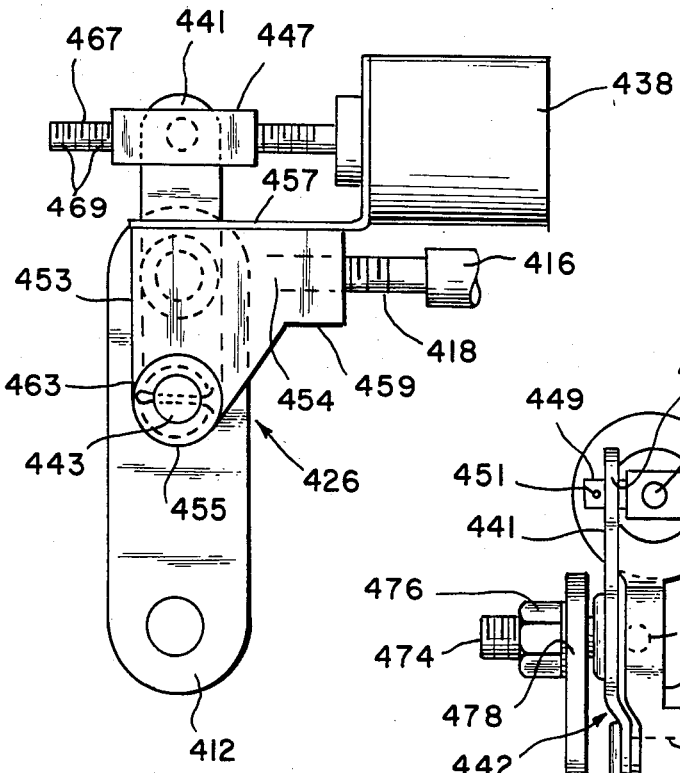
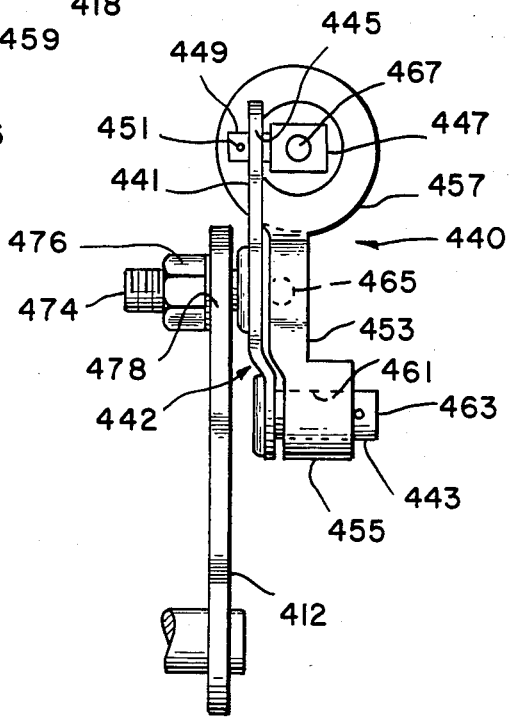
FIG. 7

FIG. 9
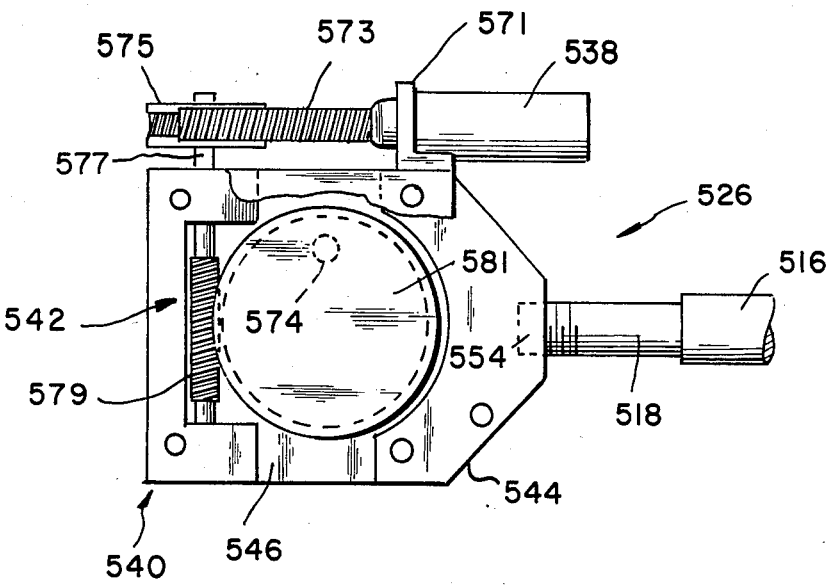
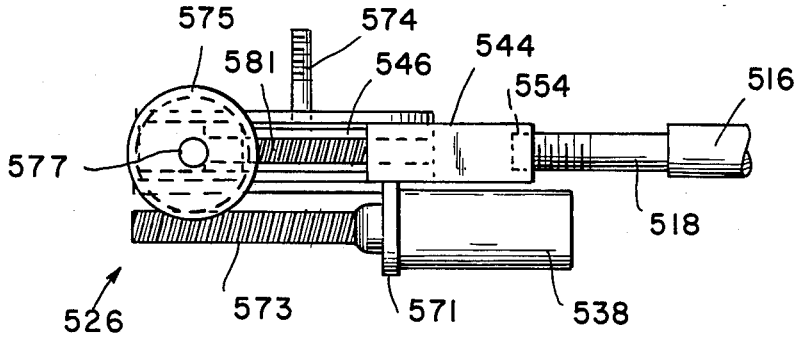
FIG. 10

TWIN ENGINE SYNCHRONIZER

FIELD OF THE INVENTION

The present invention relates to apparatus for automatically synchronizing the speeds of a plurality of engines, such as two marine or aircraft engines, and, more particularly, to such apparatus especially adapted to synchronize the speeds of gasoline or diesel engines controlled by separate hand throttle levers, each of which is connected to a respective engine by an associated control cable, such as a conventional push-pull cable.

BACKGROUND OF THE INVENTION

Devices have been proposed for synchronizing the speeds of two or more engines, each of which is controlled by a hand throttle lever acting through an associated cable, linkage or other similar means on a throttle lever of the engine. Typically, these prior devices adjust the speed of one engine (commonly referred to as the "slave engine") by moving the throttle lever associated therewith until the speed of the slave engine substantially matches the speed of the other engine (commonly referred to as the "master engine").

Generally, the prior synchronizing devices adjust the speed of the slave engine by moving the throttle lever associated with the slave engine. In addition to moving the throttle lever of the slave engine, many of these devices also move the hand throttle lever associated with the slave engine (see, for instance, U.S. Pat. Nos. 3,258,927 and 2,339,989). These devices are disadvantageous because they must generate sufficient force to overcome not only the friction of the throttle lever but also the friction of the hand throttle lever and the cable or linkage connecting the hand throttle lever to the throttle lever.

In other of the prior synchronizing devices, apparent attempts have been made to synchronize the speed of the slave engine with the speed of the master engine without having to move the hand throttle lever associated with the slave engine. Some of these devices require the modification of the cable which connects the hand throttle lever of the slave engine to the throttle lever on the slave engine (see, for instance, U.S. Pat. Nos. 3,367,110 and 3,309,871). In particular, these synchronizing devices are interposed intermediate the ends of the linkage cable connecting the hand throttle lever to the throttle lever, thereby requiring additional mounting hardware and space. In Beaman, et al. U.S. Pat. No. 3,986,363, there is disclosed an engine synchronizer which may be installed without replacing or modifying a conventional Bowden cable or similar throttle control cable used to couple the throttle lever of the slave engine to its associated hand throttle lever. However, the device disclosed in the Beaman et al. patent adjusts the position of the throttle lever of the slave engine by moving the control cable associated therewith. One problem associated with such a device is that it requires a certain amount of free space to accommodate movement of the control cable. Another disadvantage is that the stiffness of the control cable may result in erratic movement of the synchronizer.

SUMMARY OF THE PRESENT INVENTION

The present invention relates to new and improved apparatus for synchronizing the speeds of two engines, each having its own throttle lever connected by an associated cable to a respective hand throttle lever. In accordance with the improvement of the present invention, the throttle lever of one of the engines (the slave engine) is moved independently of its associated cable and its respective hand throttle lever to increase or decrease the speed of the slave engine until the speed of the slave engine matches the speed of the other engine (the master engine). Because the throttle lever of the slave engine can be moved to adjust the speed of the slave engine without moving the cable or the hand throttle lever associated with the slave engine, the present invention overcomes the problems and disadvantages of the prior synchronizing devices described above.

The present invention permits the throttle lever of the slave engine to be moved by its respective hand throttle lever or independently of the hand throttle lever. Thus, the hand throttle lever of the slave engine can be used to make rough adjustments in the speed of the slave engine, while fine adjustments in the speed of the slave engine can be made by moving the throttle lever of the slave engine independently of its respective hand throttle lever. When the throttle lever is moved independently of the hand throttle lever to make fine adjustments in the speed of the slave engine, the throttle lever moves a relatively short distance during such adjustments. Thus, in the event of synchronizer failure due to motor or actuator malfunction, the throttle lever can still be moved to an off position or a safe operating position by the hand throttle lever, thereby providing a safety feature.

In one embodiment of the present invention, a synchronizing device is mounted between the throttle lever and an adjacent end of its associated control cable, so that the throttle lever can be moved directly by the synchronizing device. By moving the throttle lever of the slave engine independently of its associated control cable and its respective hand throttle lever, the force required to move the throttle lever to achieve synchronization is relatively low because there is no need to overcome the friction of the control cable and/or the hand throttle lever, thereby permitting a compact design of the synchronizing device as well as its smooth operation. Moreover, such mounting of the synchronizing device permits it to replace a conventional right angle ball joint connector or similar device which would normally be interposed between the throttle lever and the adjacent end of the control cable, whereby little or no additional space is required to accommodate the synchronizing device and few, if any, modifications are required in the throttle lever and its associated control cable. The synchronizing device can be made more compact by mounting its actuating mechanism (e.g., a servo motor) remote from the throttle lever of the slave engine.

BRIEF DESCRIPTION OF THE DRAWINGS

For a better understanding of the present invention, reference is made to the following detailed description of several exemplary embodiments considered in conjunction with the accompanying drawings, in which:

FIG. 6 is an end view of a fifth exemplary embodiment of a synchronizing apparatus constructed in accordance with the present invention;

FIG. 7 is a left side view of the synchronizing apparatus illustrated in FIG. 6;

FIG. 9 is a side view of a sixth exemplary embodiment of a synchronizing apparatus constructed in accordance with the present invention;

FIG. 10 is a top view of the synchronizing apparatus illustrated in FIG. 9;

DESCRIPTION OF THE EXEMPLARY EMBODIMENTS

Figure 1:
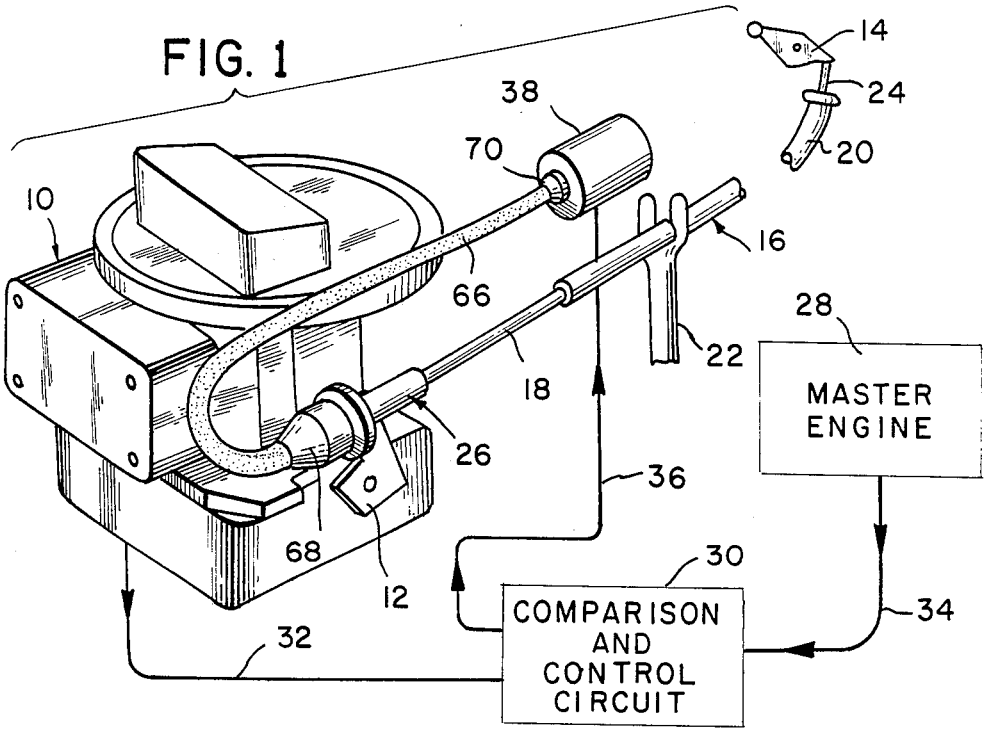
FIG. 1 is a schematic illustration of a first exemplary embodiment of a synchronizing apparatus constructed in accordance with the present invention.

Referring to FIG. 1, there is shown a slave engine 10 equipped with a pivotable throttle lever 12, which is connected to a hand throttle lever 14 by a control cable 16, such as a conventional push-pull cable. The control cable 16 includes an internal wire 18 and an outer sheath 20, which is fixedly positioned by a support arm 22 such that the wire 18 slides longitudinally within the sheath 20. The wire 18 is connected at one end 24 to the hand throttle lever 14 and at an opposite end (not shown) to a synchronizing device 26, which is carried by the throttle lever 12 in a manner to be described in greater detail hereinafter. The synchronizing device 26 attaches the control cable 16 to the throttle lever 12 such that the pivotal movement of the hand throttle lever 14 in a counterclockwise direction causes the throttle lever 12 to pivot in a clockwise direction to thereby increase the speed of the slave engine 10 in direct proportion to the amount of pivotal movement of the hand throttle lever 14 and hence the throttle lever 12. Conversely, the pivotal movement of the hand throttle lever 14 in a clockwise direction causes the throttle lever 12 to pivot in a counterclockwise direction to thereby decrease the speed of the slave engine 10 in direct proportion to the amount of the pivotal movement of the hand throttle lever 14 and hence the throttle lever 12.

Also shown in FIG. 1 is a master engine 28 which is essentially identical to the slave engine 10 except that the master engine 28 is not equipped with a synchronizing device. Thus, like the slave engine 10, the master engine 28 has a throttle lever (not shown) which is connected to a hand throttle lever (not shown) by a control cable (not shown), such as a conventional push-pull cable.

Referring still to FIG. 1, a comparison and control circuit 30, which can be an analog or digital type, is connected between the slave engine 10 and the master engine 28. More particularly, the comparison and control circuit 30 is connected to the slave engine 10 by a lead 32, which provides the comparison and control circuit 30 with signals representative of the speed of the slave engine 10, such signals being derived, for instance, from the ignition pulse of the engine, a magnetic pulse generating device or a photoelectric sensor. Similarly, the comparison and control circuit 30 is connected to the master engine 28 by a lead 34, which provides the comparison and control circuit 30 with signals representative of the speed of the master engine 28, such signals being derived, for instance, from the ignition pulse of the engine, a magnetic pulse generating device or a photoelectric sensor. The comparison and control circuit 30 is designed to compare the signals received from the slave engine 10 and the master engine 28 through the leads 32, 34, respectively, and to detect any difference between the speeds of the slave engine 10 and the master engine 28. After detecting a difference in the speeds of the slave engine 10 and the master engine 28, the comparison and control circuit 30 sends signals through a lead 36 to a servo motor 38 mounted remote from the synchronizing device 26, whereby the operation of the synchronizing device 26 is automatically controlled in response to the detected difference in the speeds of the slave engine 10 and the master engine 28.

Figure 2:
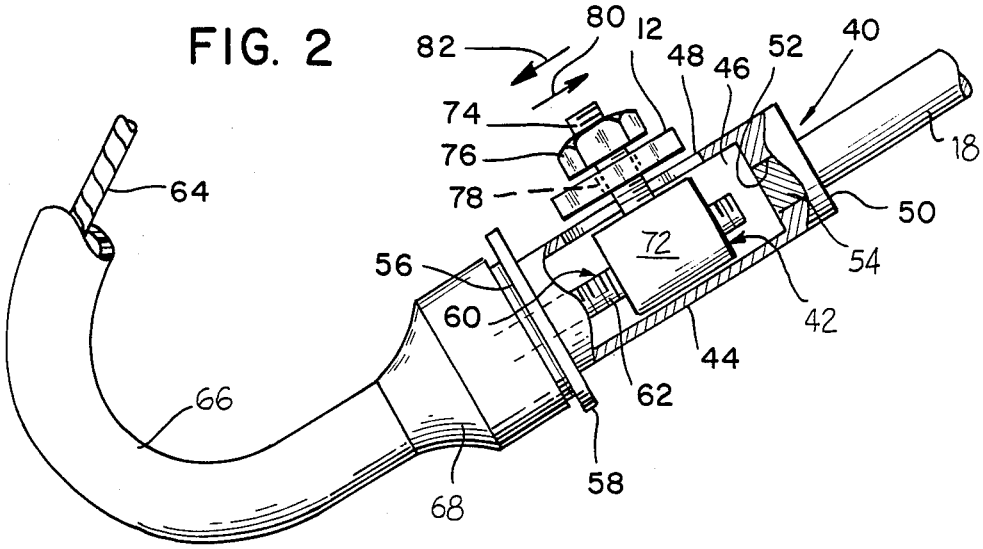
FIG. 2 is a partial cross-sectional view of the synchronizing apparatus illustrated in FIG. 1.

With particular reference to FIG. 2, the synchronizing device 26, which is actually carried by the throttle lever 12, includes a first subassembly 40 and a second subassembly 42. The first subassembly 40 includes a cylindrical housing 44 having an interior chamber 46 and an exterior slot 48, which communicates with the interior chamber 46. One end 50 of the housing 44 is provided with an opening 52 sized and shaped to receive an end 54 of the wire 18 in such a manner that the control cable 16 is fixedly attached to the housing 44 for conjoint movement therewith. An externally threaded sleeve 56 extends outwardly from an opposite end 58 of the housing 44. A rotatable worm shaft 60 is positioned in the interior chamber 46 of the housing 44. External threads 62 are provided on the worm shaft 60 for a purpose to be described hereinafter. A flexible drive shaft 64 is mechanically coupled to the worm shaft 60 such that the worm shaft 60 rotates in response to the rotation of the flexible drive shaft 64, which is rotated by an output shaft (not shown) of the servo motor 38. The flexible drive shaft 64 is housed in a flexible jacket 66. Connectors 68, 70 threadedly attach the flexible jacket 66 to the sleeve 56 and the motor 38, respectively. Alternatively, the flexible jacket 66 could be detached from the sleeve 56 and hence the housing 44.

The second subassembly 42 includes a slide 72 mounted for longitudinal reciprocating movement within the chamber 46 of the housing 44. A bolt 74 extends from the slide 72 to the throttle lever 12 through the slot 48 in the housing 44. The bolt 74, which is maintained on the throttle lever 12 by a nut 76, extends loosely through a hole 78 in the throttle lever 12 so as to permit slight pivoting of the throttle lever 12 relative to the bolt 74. The slide 72 is provided with a bore (not shown) having internal threads (not shown), which threadedly engage the external threads 62 on the worm shaft 60 such that the slide 72 moves in a linear direction 80 in response to the rotation of the worm shaft 60 in a counterclockwise direction and in an opposite linear direction 82 in response to the rotation of the worm shaft 60 in a clockwise direction. Because the slide 72 is attached to the throttle lever 12, the linear movement of the slide 72 in the direction 80 causes the throttle lever 12 to pivot in a clockwise direction, thereby automatically increasing the speed of the slave engine 10 in direct proportion to the amount of pivotal movement of the throttle lever 12. Conversely, the linear movement of the slide 72 in the direction 82 causes the throttle lever 12 to pivot in a counterclockwise direction, thereby automatically decreasing the speed of the slave engine 10 in direct proportion to the amount of pivotal movement of the throttle lever 12. Because the force required to move the throttle lever 12 is much less than the force required to move the control cable 16, the rotation of the worm shaft 60 causes the slide 72, rather than the housing 44, to move. During the movement of the slide 72, the housing 44 remains stationary so that adjustments in the speed of the slave engine 10 can be made without moving the control cable 16 or the hand throttle lever 14.

The direction of rotation of the output shaft of the motor 38 and hence the shafts 60, 64 is controlled by the comparison and control circuit 30 depending upon the difference, if any, between the speeds of the slave engine 10 and the master engine 28. If, on the one hand, the speed of the slave engine 10 is less than the speed of the master engine 28, the comparison and control circuit 30 causes the output shaft of the motor 38 and hence the shafts 60, 64 to rotate in a counterclockwise direction, resulting in the movement of the slide 72 in the direction 80 and hence the clockwise pivotal movement of the throttle lever 12 to thereby increase the speed of the slave engine 10 until the speed of the slave engine 10 matches the speed of the master engine 28. When the speed of the slave engine 10 matches the speed of the master engine 28, the comparison and control circuit 30 stops the rotation of the output shaft of the motor 38 and hence the shafts 60, 64. If, on the other hand, the speed of the slave engine 10 is greater than the speed of the master engine 28, the comparison and control circuit 30 causes the output shaft of the motor 38 to rotate in a clockwise direction, resulting in the movement of the slide 72 in the direction 82 and hence the counterclockwise pivotal movement of the throttle lever 12 to thereby decrease the speed of the slave engine 10 until the speed of the slave engine 10 matches the speed of the master engine 28. When the speed of the slave engine 10 matches the speed of the master engine 28, the comparison and control circuit 30 stops the rotation of the output shaft of the motor 38 and hence the shafts 60, 64.

As indicated above, the synchronizing device 26 attaches the control cable 16 to the throttle lever 12 such that the pivotal movement of the hand throttle lever 14 in a counterclockwise direction causes the throttle lever 12 to pivot in a clockwise direction, thereby increasing the speed of the slave engine 10 in direct proportion to the amount of pivotal movement of the hand throttle lever 14 and hence the throttle lever 12. Conversely, the pivotal movement of the hand throttle lever 14 in a clockwise direction causes the throttle lever 12 to pivot in a counterclockwise direction, thereby decreasing the speed of the slave engine 10 in direct proportion to the amount of pivotal movement of the hand throttle lever 14 and hence the throttle lever 12. Thus, the hand throttle lever 14 may be employed to make rough adjustments in the speed of the slave engine 10 for the purpose of synchronizing the speed of the slave engine 10 with the speed of the master engine 28, while the synchronizing device 26 may be employed to make fine adjustments in the speed of the slave engine 10 for the purpose of synchronizing the speed of the slave engine 10 with the speed of the master engine 28. Inasmuch as the synchronizing device 26 is intended primarily to make fine adjustments in the speed of the slave engine 10, the fact that the synchronizing device 26 translates the linear movement of the slide 72 into the pivotal movement of the throttle lever 12 does not have a deleterious affect on the operation of the synchronizing device 26.

Other exemplary embodiments of the present invention are illustrated in FIGS. 3–12. The various elements illustrated in FIGS. 3–12 which correspond to elements described above with respect to the embodiment illustrated in FIGS. 1 and 2 are designated by corresponding reference numerals increased by one hundred, two hundred, three hundred, four hundred, five hundred and six hundred respectively. All additional elements illustrated in FIGS. 3–12 which do not correspond to elements described above with respect to FIGS. 1 and 2 are designated by odd reference numerals. Unless otherwise stated, the embodiments of FIGS. 3–12 operate in the same manner as the embodiment of FIGS. 1 and 2.

Figure 3:
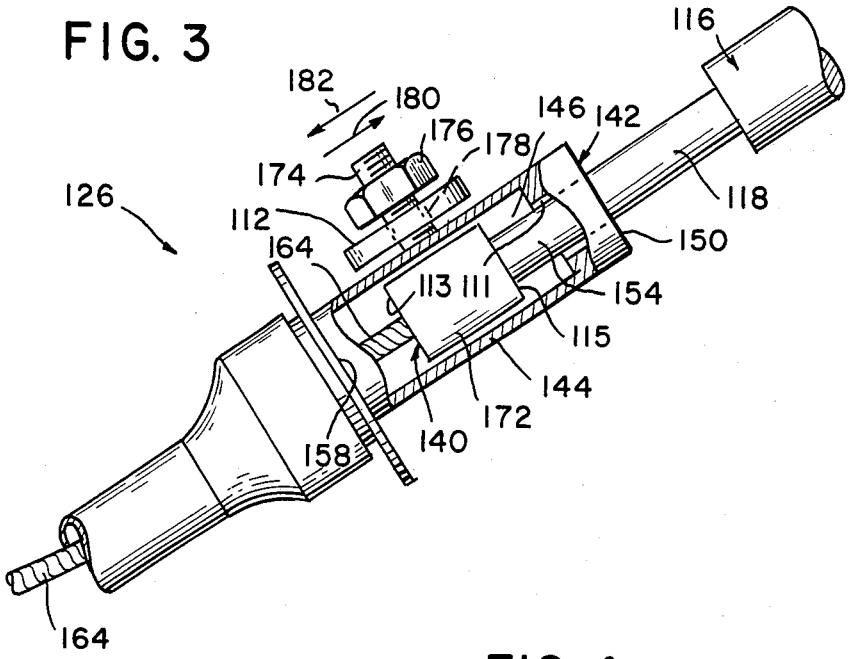
FIG. 3 is a partial cross-sectional view of a second exemplary embodiment of a synchronizing apparatus constructed in accordance with the present invention, this embodiment being a modification of the embodiment illustrated in FIGS. 1 and 2.

With reference to FIG. 3, a synchronizing device 126 for synchronizing the speed of a slave engine (not shown) to the speed of a master engine (not shown) is illustrated. The synchronizing device 126 includes a first subassembly 140 and a second subassembly 142.

The second subassembly 142 includes a housing 144 having an internal chamber 146 and an opening 111 in one end 150 of the housing 144. The opening 111 is sized such that an end 154 of a wire 118 of a control cable 116 extends therethrough. A flexible drive shaft 164 extends into the chamber 146 of the housing 144 through an opening (not shown) in an opposite end 158 of the housing 144. The flexible drive shaft 164 is coupled to a linearly movable output shaft of a remotely mounted motor (not shown). A bolt 174 extends from the housing 144 through a hole 178 in a throttle lever 112 of the slave engine (not shown). The bolt 174 is maintained on the throttle lever 112 by a nut 176.

The first subassembly 140 includes a slide 172 mounted in the chamber 146 of the housing 144. The flexible drive shaft 164 is fixedly attached to one end 113 of the slide 172. The wire 118 is fixedly attached to an opposite end 115 of the slide 172. Because the force required to move the throttle lever 112 is much less than the force required to move the control cable 116, the movement of the flexible drive shaft 164 causes the housing 144, rather than the slide 172, to move. Thus, the housing 144 moves in a linear direction 180 in response to the extension of the flexible drive shaft 164, whereby the throttle lever 112 is rotated in a clockwise direction to increase the speed of the slave engine (not shown). Conversely, the housing 144 moves in an opposite linear direction 182 in response to the retraction of the flexible drive shaft 164, whereby the throttle lever 112 is rotated in a counterclockwise direction to decrease the speed of the slave engine (not shown).

Figure 4:
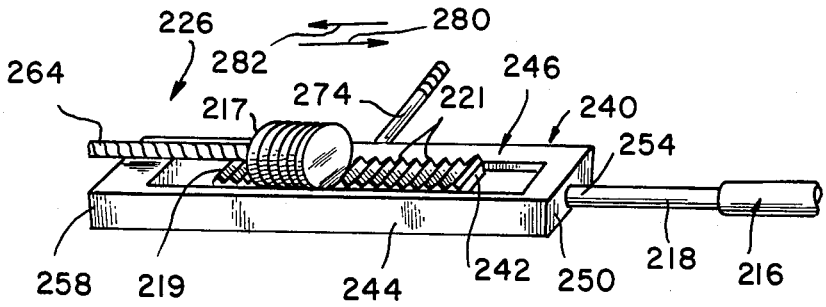
FIG. 4 is a schematic illustration of a third exemplary embodiment of a synchronizing apparatus constructed in accordance with the present invention.

In FIG. 4, there is shown a synchronizing device 226 for synchronizing the speed of a slave engine (not shown) to the speed of a master engine (not shown). The synchronizing device 226 includes a first subassembly 240 and a second subassembly 242.

The first subassembly 240 includes a housing 244 having an interior chamber 246 and a slot (not shown) which communicates with the interior chamber 246. One end 250 of the housing 244 receives an end 254 of a wire 218 in such a manner that a control cable 216 is fixedly attached to the housing 244, A flexible drive shaft 264 extends into the chamber 246 of the housing 244 through an opening (not shown) in an opposite end 258 of the housing 244. The flexible drive shaft 264 is coupled to a rotatable output shaft of a remotely mounted motor (not shown). A worm gear 217 is attached to the flexible drive shaft 264 for conjoint rotation therewith.

The second subassembly 242 includes a rack 219 and a bolt 274, which extends from the rack 219 to a throttle lever (not shown) of a slave engine (not shown) through the slot (not shown) in the housing 244. The rack 219 is provided with teeth 221 designed so as to mesh with the worm gear 217 such that the rack 219 moves in a linear direction 280 in response to the rotation of the flexible drive shaft 264 in a counterclockwise direction and in an opposite linear direction 282 in response to the rotation of the flexible drive shaft 264 in a clockwise direction.

Figure 5:
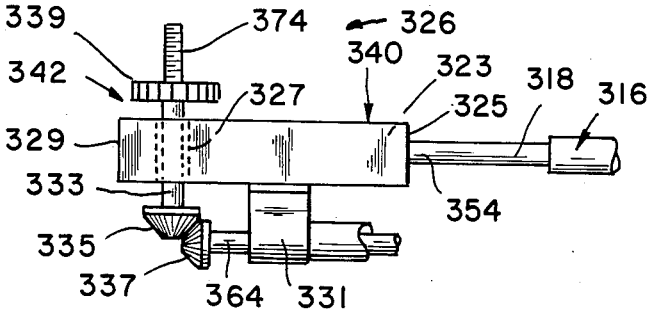
FIG. 5 is a schematic illustration of a fourth exemplary embodiment of a synchronizing apparatus constructed in accordance with the present invention.

In FIG. 5, there is shown a synchronizing device 326 for synchronizing the speed of a slave engine (not shown) with the speed of a master engine (not shown). The synchronizing device 326 includes a first subassembly 340 and a second subsassembly 342.

The first subassembly 340 includes a mounting block 323. An end 354 of a wire 318 is attached to one end 325 of the mounting block 323 in such a manner that a control cable 316 is fixedly attached to the mounting block 323. A hole 327 extends through an opposite end 329 of the mounting block 323. A flexible drive shaft 364 is mounted on the mounting block 323 by a bracket 331.

The second subassembly 342 includes a rotatable axle 333 which extends through the hole 327 in the mounting block 323. The axle 333 carries a bevel gear 335. Another bevel gear 337, which meshes with the bevel gear 335, is attached to the flexible drive shaft 364 such that rotation of the flexible drive shaft 364 in a clockwise direction causes the axle 333 to rotate in a counterclockwise direction, while the rotation of the flexible drive shaft 364 in a counterclockwise direction causes the axle 333 to rotate in a clockwise direction. A plate 339 is also carried by the axle 333. The plate 339 is provided with an eccentrically mounted bolt 374, which extends to a throttle lever (not shown) on the slave engine (not shown). By this arrangement, the plate 339 and hence the bolt 374 rotate in a clockwise direction in response to the clockwise rotation of the axle 333 to thereby pivot the throttle lever (not shown) of the slave engine (not shown) in a clockwise direction for the purpose of increasing the speed of the slave engine (not shown). Conversely, the plate 339 and hence the bolt 374 rotate in a counterclockwise direction in response to the counterclockwise rotation of the axle 333 to thereby pivot the throttle lever (not shown) of the slave engine (not shown) in a counterclockwise direction for the purpose of decreasing the speed of the slave engine (not shown).

Figure 8:
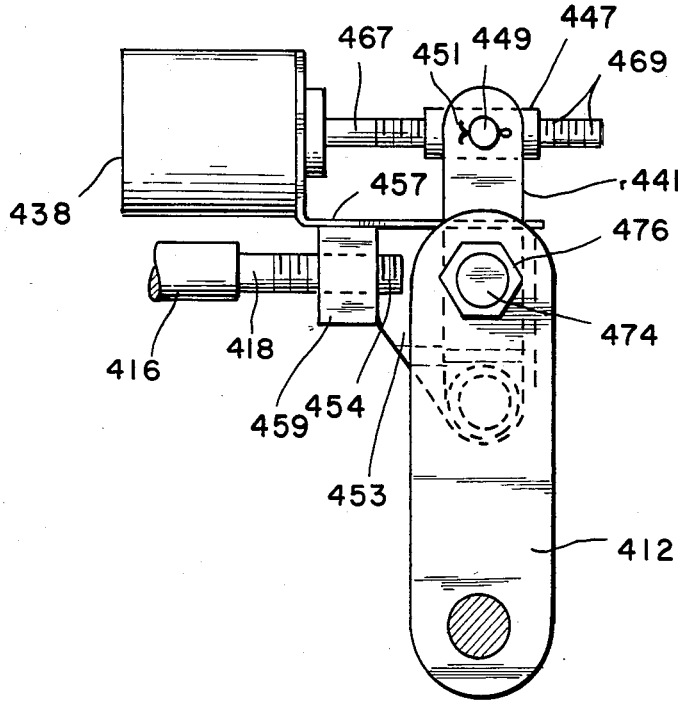
FIG. 8 is a right side view of the synchronizing apparatus illustrated in FIG. 6.

With reference now to FIGS. 6–8, a synchronizing device 426 for synchronizing the speed of a slave engine (not shown) to the speed of a master engine (not shown) is illustrated. The synchronizing device 426 includes a first subassembly 440 and a second subassembly 442.

The second subassembly 442 includes a link 441 having a pivot pin 443 at one end thereof, a hole 445 in an opposite end thereof and a bolt 474 between the pivot pin 443 and the hole 445. The pivot pin 443 extends outwardly from one side of the link 441, whereas the bolt 474 extends outwardly from the opposite side of the link 441. The link 441 is pivotally attached to an adjusting nut 447 by a pin 449 which extends through a hole 445 and the link 441 such that the link 441 can pivot about the pin 449. The link 441 is maintained on the pin 449 by a cotter pin 451. The bolt 474 extends through a hole 478 in a throttle lever 412 of the slave engine (not shown). The bolt 474 is maintained on the throttle lever 412 by a nut 476.

The first subassembly 440 includes a carrier 453 having a sleeve 455 on one end thereof and a bracket 457 attached to an opposite end thereof. Another sleeve 459 is positioned below the bracket 457. The sleeve 445 has a bore 461 which is sized and shaped so as to receive the pivot pin 443 of the second subassembly 442 such that the carrier 453 can pivot about the pivot pin 443. A cotter pin 463 maintains the carrier 453 on the pivot pin 443. The sleeve 459 has an internally threaded bore 465 which is sized and shaped so as to receive an end 454 of a wire 418 of a control cable 416. A servo motor 438 is mounted on the bracket 457. The motor 438 includes a rotatable output shaft 467 having external threads 469 which are adapted to threadedly engage internal threads (not shown) provided in the adjusting nut 447.

In operation, because the force required to move the throttle lever 412 is much less than the force required to move the control cable 416, the movement of the output shaft 467 of the motor 438 causes the link 441, rather than the carrier 453, to move. Thus, the adjusting nut 447 moves in a linear direction 480 in response to the rotation of the output shaft 467 in a counterclockwise direction, whereby the link 441 and hence the throttle lever 412 are rotated in a clockwise direction to increase the speed of the slave engine (not shown). Conversely, the adjusting nut 447 moves in an opposite linear direction 482 in response to the rotation of the output shaft 467 in a clockwise direction, whereby the link 441 and hence the throttle lever 412 are rotated in a counterclockwise direction to decrease the speed of the slave engine (not shown).

With reference to FIGS. 9–10, a synchronizing device 526 for synchronizing the speed of a slave engine (not shown) to the speed of a master engine (not shown) is illustrated. The synchronizing device 526 includes a first subassembly 540 and a second subassembly 542.

The first subassembly 540 includes a housing 544. An end 554 of a wire 518 is attached to one end 550 of the housing 544 in such a manner that a control cable 516 is fixedly attached to the housing 544. The housing 544 includes an inner chamber 546. A motor 538, having a rotatable output shaft (not shown) is mounted on the housing 544 by a bracket 571. A worm screw 573 is attached to the output shaft (not shown) of the motor 538 for conjoint rotation therewith. The worm screw 573 meshes with a worm gear 575, which is mounted externally of the housing 544 on a rotatable shaft 577 extending into the housing 544 such that the clockwise rotation of the output shaft (not shown) of the motor 538 and hence the worm screw 573 results in the rotation of the worm gear 575 and hence the shaft 577 in one direction and such that the counterclockwise rotation of the output shaft (not shown) of the motor 538 and hence the worm screw 573 results in the rotation of the worm gear 575 and hence the shaft 577 in an opposite direction.

The second subassembly 542 includes a worm screw 579, which is rotatably mounted in the chamber 546 of the housing 544 on the shaft 577 for conjoint rotation therewith, and a worm gear 581, which is rotatably mounted in the chamber 546 of the housing 544 in meshing engagement with the worm screw 579. The worm gear 581 is provided with an eccentrically mounted bolt 574, which extends to a throttle lever (not shown) on the slave engine (not shown). By this arrangement, the worm gear 581 and hence the bolt 574 rotate in a clockwise direction in response to the rotation of the shaft 577 and hence the worm gear 575 in one direction to thereby pivot the throttle lever (not shown) of the slave engine (not shown) in a clockwise direction for the purpose of increasing the speed of the slave engine (not shown). In this regard, the gearing is designed such that it performs a reduction function, whereby the rotational speed of the output shaft (not shown) of the motor 538 is much greater than the rotational speed of the worm gear 581 and hence the bolt 574. Conversely, the worm gear 581 and hence the bolt 574 rotate in a counterclockwise direction in response to the rotation of the shaft 577 and hence the worm gear 575 in an opposite direction to thereby pivot the throttle lever (not shown) of the slave engine (not shown) in a counterclockwise direction for the purpose of decreasing the speed of the slave engine (not shown).

Figure 11:
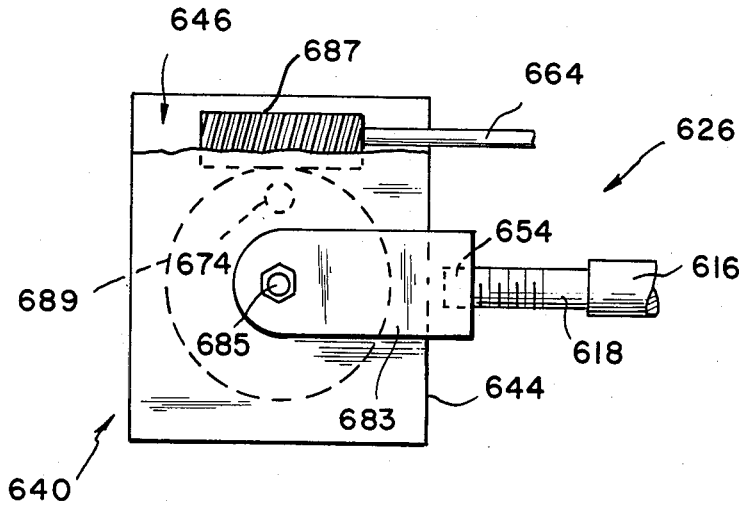
FIG. 11 is a side view of a seventh exemplary embodiment of a synchronizing apparatus constructed in accordance with the present invention.
Figure 12:
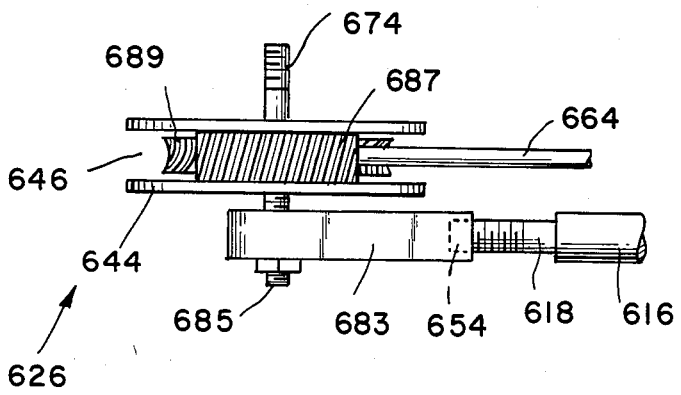
FIG. 12 is a top view of the synchronizing apparatus illustrated in FIG. 11.

Referring now to FIGS. 11–12, a synchronizing device 626 for synchronizing the speed of a slave engine (not shown) to the speed of a master engine (not shown) is illustrated. The synchronizing device 626 includes a first subassembly 640 and a second subassembly 642.

The first subassembly 640 includes a housing 644. An end 654 of a wire 618 of a control cable 616 is fixedly attached to a conventional end link 683. A post 685 extending outwardly from one side of the housing 644 receives the end link 683 in such a manner that the control cable 616 is fixedly attached to the housing 644. The housing 644 includes an inner chamber 646. A flexible drive shaft 664, which is coupled to a rotatable output shaft (not shown) of a remotely mounted motor (not shown), extends into the chamber 646 of the housing 644. A worm screw 687 mounted in the chamber 646 of the housing 644 is attached to the drive shaft 664 for conjoint rotation therewith.

The second subassembly 642 includes a worm gear 689, which is rotatably mounted in the chamber 646 of the housing 644 in meshing engagement with the worm screw 687. The worm gear 689 is provided with an eccentrically mounted bolt 674, which extends to a throttle lever (not shown) on the slave engine (not shown). Although the post 685 is formed integrally with the housing 644, it could be formed as part of the worm gear 689 in which case it would be coaxial with the worm gear 689 and would extend outwardly from the housing 644 through a hole therein. Regardless of whether the post 685 is part of the housing 644 or part of the worm gear 689, the worm gear 689 and hence the bolt 674 rotate in a clockwise direction in response to the rotation of the drive shaft 664 and hence the worm screw 687 in one direction to thereby pivot the throttle lever (not shown) of the slave engine (not shown) in a clockwise direction for the purpose of increasing the speed of the slave engine (not shown). If reduction gearing is desired, it can be built into the motor (not shown). Conversely, the worm gear 689 and hence the bolt 674 rotate in a counterclockwise direction in response to the rotation of the drive shaft 664 and hence the worm screw 687 in an opposite direction to thereby pivot the throttle lever (not shown) of the slave engine (not shown) in a counterclockwise direction for the purpose of decreasing the speed of the slave engine (not shown).

It will be understood that the embodiments described herein are merely exemplary and that a person skilled in the art may make many variations and modifications without departing from the spirit and scope of the invention. For instance, the embodiments of FIGS. 6–8 and 11–12 of the present application, as well as all of the embodiments disclosed in my copending U.S. patent application Ser. No. 492,735, filed May 9, 1983, could be provided with remotely mounted motors. All such modifications and variations are intended to be included within the scope of the invention as defined in the appended claims.

I claim:

1. Apparatus for synchronizing the speeds of two engines, each having its own throttle lever connected by an associated cable to a respective hand throttle lever, comprising moving means carried by said throttle lever of one of said engines for moving said throttle lever of said one engine independently of its associated cable and its respective hand throttle lever to increase or decrease the speed of said one engine until the speed of said one engine matches the speed of the other engine, whereby said moving means moves said throttle lever of said one engine without moving its associated cable or its respective hand throttle lever, and actuating means mounted remote from said throttle lever of said one engine for actuating said moving means.

2. Apparatus according to claim 1, further comprising detecting means for detecting a difference in the speeds of said engines and controlling means for controlling said moving means in response to said difference in speed detected by said detecting means.

3. Apparatus according to claim 1, further comprising attaching means for attaching said moving means to said throttle lever of said one engine and its associated cable such that the movement of said cable by its respective hand throttle lever results in a corresponding movement of said throttle lever of said one engine, whereby said hand throttle lever may be employed to make rough adjustments in the speed of said one engine for the purpose of synchronizing the speed of said engine with the speed of said other engine and said moving means may be employed to make fine adjustments in the speed of said one engine for the purpose of synchronizing the speed of said one engine with the speed of said other engine.

4. Apparatus according to claim 1, wherein said moving means includes a first subassembly mounted for movement relative to said throttle lever of said one engine and a second subassembly mounted for movement relative to said first subassembly and connected to said throttle lever of said one engine such that said throttle lever of said one engine moves conjointly with said second subassembly during at least a portion of the movement of said second subassembly.

5. Apparatus according to claim 4, wherein said second subassembly is mounted for linear reciprocating movement relative to said first subassembly.

6. Apparatus according to claim 5, wherein said actuating means includes a motor having a rotatable output shaft.

7. Apparatus according to claim 6, wherein said moving means further includes external threads provided on a rotatable worm shaft and internal threads provided in said second subassembly, said internal threads threadedly engaging said external threads such that said second subassembly moves in a first linear direction in response to the rotation of said worm shaft in a first rotational direction and in a second linear direction opposite to said first linear direction in response to the rotation of said worm shaft in a second rotational direction opposite to said first rotational direction.

8. Apparatus according to claim 7, wherein said first subassembly includes a housing within which said worm shaft is mounted and said second subassembly includes a slide mounted within said housing and a bolt extending through said housing to connect said slide to said throttle lever of said one engine.

9. Apparatus according to claim 8, wherein said first subassembly includes attaching means for fixedly attaching an end of said cable associated with said throttle lever of said one engine to said housing.

10. Apparatus according to claim 9, wherein said actuating means further includes connecting means for connecting said output shaft of said motor to said worm shaft of said moving means.

11. Apparatus according to claim 10, wherein said connecting means includes a flexible drive shaft.

12. Apparatus according to claim 6, wherein said moving means further includes a rotatable gear and gear teeth provided on said second subassembly, said gear teeth meshing with said gear such that said second subassembly moves in a first linear direction in response to the rotation of said gear in a first rotational direction and in a second linear direction opposite to said first linear direction in response to the rotation of said gear in a second rotational direction opposite to said first rotational direction.

13. Apparatus according to claim 12, wherein said first subassembly includes a housing within which said gear is mounted and said second subassembly includes a rack mounted within said housing and a bolt extending through said housing to connect said rack to said throttle lever of said one engine.

14. Apparatus according to claim 13, wherein said first subassembly includes attaching means for fixedly attaching an end of said cable associated with said throttle lever of said one engine to said housing.

15. Apparatus according to claim 12, wherein said gear is a worm gear.

16. Apparatus according to claim 15, wherein said actuating means further includes connecting means for connecting said output shaft of said motor to said worm gear of said moving means.

17. Apparatus according to claim 16, wherein said connecting means includes a flexible drive shaft.

18. Apparatus according to claim 5, wherein said actuating means includes a motor having a linearly movable output shaft.

19. Apparatus according to claim 18, wherein said second subassembly includes a housing and a bolt extending between said housing and said throttle lever of said one engine and said first subassembly includes a slide mounted within said housing.

20. Apparatus according to claim 19, wherein said first subassembly includes attaching means for fixedly attaching an end of said cable associated with said throttle lever of said one engine to said slide.

21. Apparatus according to claim 20, wherein said actuating means further includes connecting means for connecting said output shaft of said motor to said slide.

22. Apparatus according to claim 21, wherein said connecting means includes a flexible drive shaft.

23. Apparatus according to claim 4, wherein said actuating means includes a motor having a rotatable output shaft.

24. Apparatus according to claim 23, wherein said first subassembly includes a mounting block and said second subassembly includes a rotatable axle extending through said mounting block, a first rotatable bevel gear, a second rotatable bevel gear mounted on said axle for conjoint rotation therewith, said second bevel gear meshing with said first bevel gear such that said second bevel gear rotates in response to the rotation of said first bevel gear, and a bolt eccentrically mounted on said axle, said bolt being connected to said throttle lever of said one engine.

25. Apparatus according to claim 24, wherein said first subassembly includes attaching means for fixedly attaching an end of said cable associated with said throttle lever of said one engine to said mounting block.

26. Apparatus according to claim 25, wherein said actuating means further includes connecting means for connecting said output shaft of said motor to said first bevel gear.

27. Apparatus according to claim 26, wherein said connecting means includes a flexible drive shaft.

28. Apparatus according to claim 23, wherein said first subassembly includes a housing and said second subassembly includes a rotatable worm screw mounted within said housing, a rotatable worm gear mounted within said housing, said worm gear meshing with said worm screw such that said worm gear rotates in response to the rotation of said worm screw, and a bolt eccentrically mounted on said worm gear, said bolt extending outwardly from said housing and being connected to said throttle lever of said one engine.

29. Apparatus according to claim 28, wherein said actuating means further includes connecting means for connecting said output shaft of said motor to said worm screw.

30. Apparatus according to claim 29, wherein said connecting means includes a flexible drive shaft.

31. Apparatus according to claim 30, wherein said first subassembly includes attaching means for fixedly attaching an end of said cable associated with said throttle lever of said one engine to said housing.

32. Apparatus according to claim 28, wherein said second subassembly includes attaching means for fixedly attaching an end of said cable associated with said throttle lever of said one engine to said housing.

33. Apparatus for synchronizing the speeds of two engines, each having its own throttle lever connected by an associated cable to a respective hand throttle lever, comprising moving means carried by said throttle lever of one of said engines for moving said throttle lever of said one engine independently of its associated cable and its respective hand throttle lever to increase or decrease the speed of said one engine until the speed of said one engine matches the speed of the other engine, whereby said moving means moves said throttle lever of said one engine to adjust the speed of said one engine without moving its associated cable or its respective hand throttle lever, said moving means including a first subassembly fixedly positioned relative to said throttle lever of said one engine, said first subassembly including a housing, a first rotatable worm screw, a rotatable shaft extending into said housing, and a first rotatable worm gear mounted on said shaft for conjoint rotation therewith, said first worm gear meshing with said first worm screw such that said first worm gear rotates in response to the rotation of said first worm screw, a second subassembly mounted for movement relative to said first subassembly and connected to said throttle lever of said one engine such that said throttle lever of said one engine moves conjointly with said second subassembly during at least a portion of the movement of said second subassembly, said second subassembly including a second worm screw mounted on said shaft for conjoint rotation therewith, a second worm gear mounted within said housing, said second worm gear meshing with said second worm screw such that said second worm gear rotates in response to the rotation of said second worm screw, and a bolt eccentrically mounted on said second worm gear, said bolt extending outwardly from said housing and being connected to said throttle lever of said one engine, a motor having a rotatable output shaft, said motor being mounted on said housing of said first subassembly, and connecting means for connecting said output shaft of said motor to said first worm screw such that said first worm screw rotates conjointly with said output shaft of said motor.

34. Apparatus according to claim 33, wherein said first subassembly further includes attaching means for fixedly attaching an end of said cable associated with said throttle lever of said one engine to said housing.

35. Apparatus according to claim 33, wherein said second subassembly further includes attaching means for fixedly attaching an end of said cable associated with said throttle lever of said one engine to said second worm gear such that said end of said cable is fixed relative to said housing.

36. Apparatus according to claim 33, further comprising detecting means for detecting a difference in the speeds of said engines and controlling means for controlling said moving means in response to said difference in speed detected by said detecting means.

37. Apparatus according to claim 33, further comprising attaching means for attaching said moving means to said throttle lever of said one engine and its associated cable such that the movement of said cable by its respective hand throttle lever results in a corresponding movement of said throttle lever of said one engine, whereby said hand throttle lever may be employed to make rough adjustments in the speed of said one engine for the purpose of synchronizing the speed of said one engine with the speed of said other engine and said moving means may be employed to make fine adjustments in the speed of said one engine for the purpose of synchronizing the speed of said one engine with the speed of said other engine.

38. Apparatus for synchronizing the speeds of two engines, each having its own throttle lever connected by an associated cable to a respective hand throttle lever, comprising moving means carried by said throttle lever of one of said engines for moving said throttle lever of said one engine independently of its associated cable and its respective hand throttle lever to increase or decrease the speed of said one engine until the speed of said one engine matches the speed of the other engine, whereby said moving means moves said throttle lever of said one engine to adjust the speed of said one engine without moving its associated cable or its respective hand throttle lever, said moving means including a first subassembly fixedly positioned relative to said throttle lever of said one engine, a second subassembly mounted for movement relative to said first subassembly and connected to said throttle lever of said one engine such that said throttle lever of said one engine moves conjointly with said second subassembly during at least a portion of the movement of said second subassembly, said first subassembly including an adjusting nut and a link connected between said adjusting nut and said throttle lever of said one engine such that said throttle lever of said one engine rotates in a first rotational direction in response to the movement of said adjusting nut in a first linear direction and in a second rotational direction opposite to said first rotational direction in response to the movement of said adjusting nut in a second linear direction opposite to said first linear direction, said link being pivotally attached to said first subassembly such that said first subassembly does not move in response to the rotation of said link in said first and second rotational directions, a motor having a rotatable output shaft, said motor being mounted on said first subassembly, and connecting means for connecting said output shaft of said motor to said second subassembly such that said adjusting nut moves in said first linear direction in response to the rotation of said output shaft in one rotational direction and in said second linear direction in response to the rotation of said output shaft in an opposite rotational direction.

39. Apparatus according to claim 38, further comprising detecting means for detecting a difference in the speeds of said engines and controlling means for controlling said moving means in response to said difference in speed detected by said detecting means.

40. Apparatus according to claim 38, further comprising attaching means for attaching said moving means to said throttle lever of said one engine and its associated cable such that the movement of said cable by its respective hand throttle lever results in a corresponding movement of said throttle lever of said one engine, whereby said hand throttle lever may be employed to make rough adjustments in the speed of said one engine for the purpose of synchronizing the speed of said one engine with the speed of said other engine and said moving means may be employed to make fine adjustments in the speed of said one engine for the purpose of synchronizing the speed of said one engine with the speed of said other engine.

41. Apparatus according to claim 40, wherein said first subassembly includes attaching means for fixedly attaching an end of said cable associated with said throttle lever of said one engine to said housing.

* * * * *